United States Patent [19]

Caldwell

[11] 4,247,266

[45] Jan. 27, 1981

[54] FLUID PUMP DRIVE SYSTEM

[75] Inventor: Richard K. Caldwell, Arlington Heights, Ill.

[73] Assignee: Vapor Corporation, Chicago, Ill.

[21] Appl. No.: 12,651

[22] Filed: Feb. 16, 1979

[51] Int. Cl.[3] ..... F04B 39/06

[52] U.S. Cl. ..... 417/567; 165/47

[58] Field of Search ..... 417/567, 92, 243; 222/146 C; 165/47; 366/144, 145, 147

[56] References Cited

U.S. PATENT DOCUMENTS

| | | | |
|---|---|---|---|
| 1,051,410 | 1/1913 | Howard . | |
| 1,159,201 | 11/1915 | Ferraris . | |
| 1,697,682 | 1/1929 | Ferraris | 417/92 |
| 1,839,878 | 1/1932 | Huber . | |
| 3,241,496 | 3/1966 | Masaharu | 417/98 |
| 3,802,802 | 4/1974 | Greer . | |
| 3,930,756 | 1/1976 | Bruggeman . | |
| 3,972,654 | 8/1976 | Clayton | 417/388 |
| 3,977,192 | 8/1976 | Smirnov . | |

OTHER PUBLICATIONS

Manual for Clayton Steam Generator.

*Primary Examiner*—Robert W. Jenkins
*Attorney, Agent, or Firm*—Francis J. Lidd

[57] ABSTRACT

A pump drive system (10) for pumping high temperature fluid includes a fluid pump (12) defined by a housing. The pump includes a fluid piston (16) for developing an impulse for pumping the fluid through the system (18). A fluid column (24) is included that is in fluid communication with the high temperature fluid system (20) and the piston (16) of the pump. The fluid column includes valves 54, 56 for introducing and exhausting fluid from the column during the pumping stroke of the plunger. During operation of the pump, high temperature fluid is introduced in the fluid column through the valves, mixed with the fluid within the column and pumped through the valve into the fluid system thereby pumping the fluid while maintaining the temperature adjacent to the fluid piston at a reduced level to insure lubrication of the piston packing (52) while preventing deterioration.

11 Claims, 2 Drawing Figures

FLUID PUMP DRIVE SYSTEM

BACKGROUND OF THE INVENTION

1. Field of the Invention

The device of the present invention relates to an improvement for a feed water pump drive system.

2. Description of the Prior Art

Reciprocating pumps are employed to force or pump high temperature fluid at a high velocity to a fluid utilization device such as the coils of a boiler. Due to the high temperature of the fluid being pumped, it has been necessary in the prior art to prevent the high temperature fluid from coming into immediate contact with the plunger and the plunger packing since the high temperatures will rapidly deteriorate the packing. This deterioration of the packing results in rapid wear of the plunger and scoring of the plunger and plunger cylinder.

Accordingly, typical prior art devices employ structure for separating the high temperature fluid from the plunger. Such prior art devices are illustrated in U.S. Pat. Nos. 3,241,496 and 3,972,654. In the prior art systems, the plunger is physically separated from the high temperature fluid by a diaphragm or a similar member. Due to this separation, there is a necessity to provide separate structure for lubricating the packing surrounding the plunger. A complete separate lubrication system is normally provided in the prior art systems increasing the cost of the pump and the complexity of its manufacture and assembly.

The system of the present application is an improvement of the system illustrated in U.S. Pat. No. 4,090,719 assigned to the assignee of the present invention and that patent is incorporated by reference herein.

SUMMARY OF THE INVENTION

An object of the present invention is to provide a new and improved system for pumping high temperature fluids.

Another object of the present invention is to provide a new and improved system for pumping high temperature fluids including a piston type pump wherein the piston is in physical contact with the fluid being pumped.

The present invention is directed to a new and improved system for pumping high temperature fluids at a required pressure with a plunger or piston type reciprocating positive displacement pump. In the preferred embodiment illustrated herein, a piston type reciprocating pump is illustrated; however, it is not intended to limit the invention to this particular type of pump.

The present invention includes a fluid mixing column communicating the high temperature fluid with the plunger or piston of the pump. Cooling jackets are placed around the column to cool the fluid and develop a temperature gardient of the fluid in the column. The fluid within the column is mixed with the high temperature fluid such that the fluid that is in direct contact with the piston is of a sufficiently low temperature so as not to induce deterioration of the piston packing. As a result of the present invention, the life of the packing is increased and lubrication of the piston is provided. Accordingly, this present invention simplifies the structure of the pumping system and reduces the cost of its assembly and use.

BRIEF DESCRIPTION OF THE DRAWING

The above and other objects and advantages and novel features of the present invention will become apparent from the following detailed description of a preferred embodiment of the invention illustrated in the accompanying drawing wherein.

DETAILED DESCRIPTION OF THE PREFERRED EMBODIMENT

Figure 1:
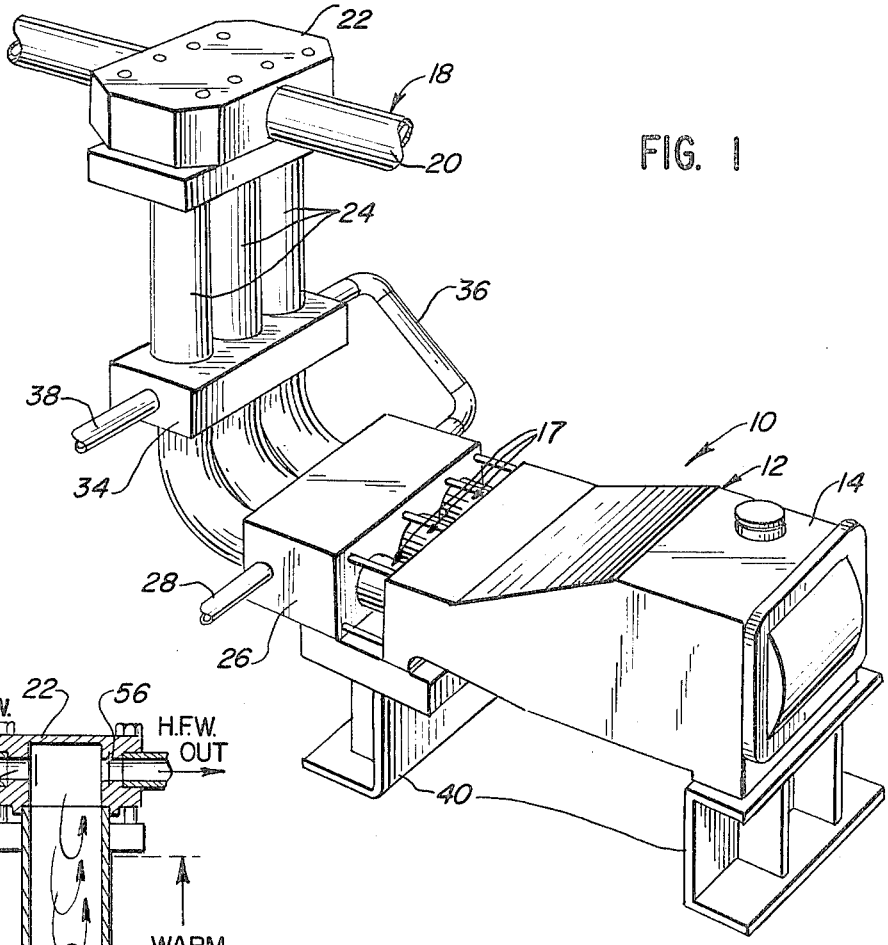
FIG. 1 is a perspective view of the system of the present invention.

Referring now to the drawing and initially to FIG. 1 there is illustrated a pump drive system generally designated by the reference numeral 10. The system 10 includes a pump 12 defined within the housing 14 and includes a plurality of cylinder assemblies 17 containing reciprocating pistons 16. The pistons 16 are employed to pump fluid in a fluid system generally designated by the reference numeral 18. The system 18 includes a fluid conduit 20 extending from a source of high temperature fluid to a fluid utilization device such as boiler coils. Flow through conduit 20 is controlled and directed to the pump 12 by a valve chamber 22. The valve chamber 22 is in fluid communication with the pump 12 through a plurality of fluid or mixing columns 24.

The portion of each fluid column 24 adjacent to each cylinder assembly 17 is surrounded by a cooling jacket 26 that is in fluid communication with cold fluid through the inlet pipe 28. The jacket 26 is also in fluid communication with a second cooling jacket 34 that surrounds an upper portion of each fluid column 24 through the immediate connecting pipe 36. Once the cooling fluid has passed through the jacket 34, it is exhausted through the exhaust pipe 38 and returned to a reservoir (not shown) to be cooled and recirculated through the jackets 26 and 34.

The pump 12 may be mounted on a frame support structure 40 and located adjacent to the hot water system 18.

Figure 2:
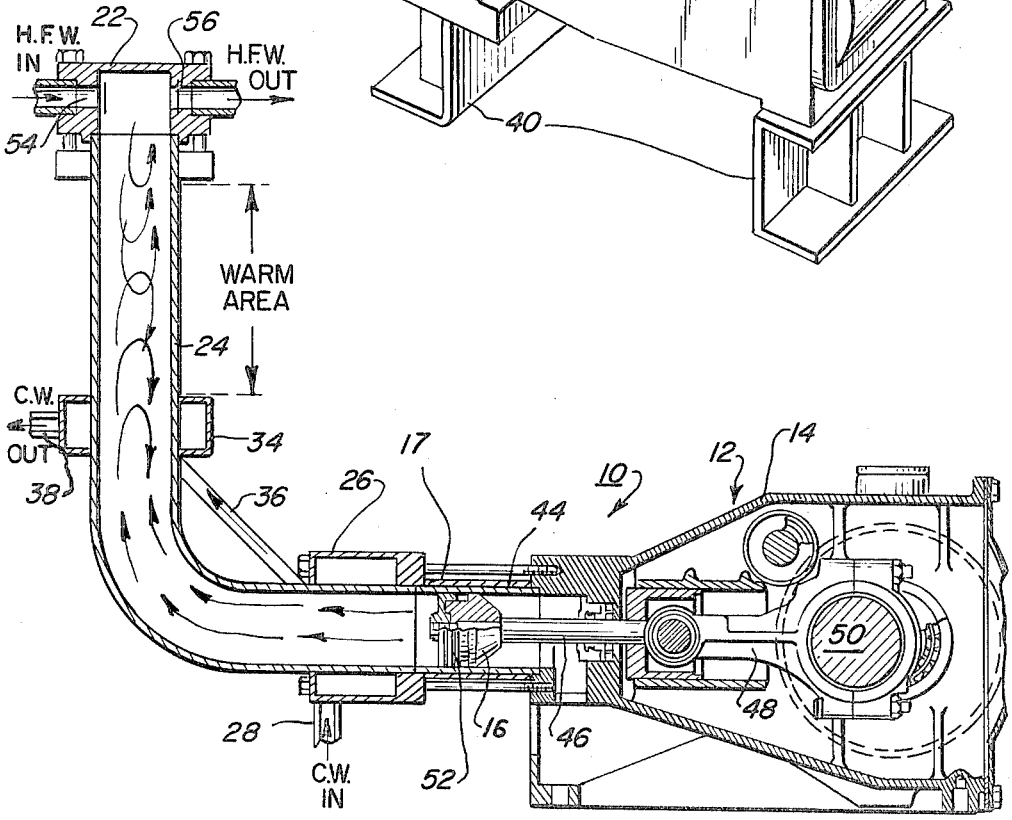
FIG. 2 is a cross-sectional view of the device of the present invention.

Having reference now to FIG. 2, the system 10 is illustrated in greater detail. Since the pump 12 may be of any type, only a brief description will be provided. A more detailed description of the pump is provided in U.S. Pat. Nos. 3,558,244 and 3,652,188. Briefly, however, the pump 12 includes a piston 16 that is reciprocated in the piston cylinder assembly 17, containing a liner 44 for improved wear characteristics. The piston 16 is connected by a piston rod 46 to a driving pitman 48 that in turn is connected to a main shaft 50 of the pump 12. The main shaft is connected, sometimes through a countershaft to a high speed source of rotary power such as an electric motor (not shown) resulting in reciprocation of the piston 16 within the cylinder liner 44.

The piston 16, as illustrated, is in direct fluid communication with the fluid in the fluid column 24 and the piston packing 52 is lubricated by this fluid. The fluid column 24 illustrated is cylindrical and of an L shape. The upper portion of the column 24 is in fluid communication and connected to the valve chamber 22. The valve chamber 22 includes an inlet valve 54 that allows the inflow of high temperature fluid into the upper portion of the column 24 during the suction stroke of the piston 16.

As each suction stroke is accomplished, the high temperature fluid is drawn into the upper portion of the mixing column 24 through the inlet valve 54 and mixes with the fluid in column 24. Accordingly, a temperature gradient is developed within the cooling column 24 with the higher temperatures being near the valve chamber 22 and the lower temperature adjacent the piston 16, thus protecting the piston 16 and packing 52 from the high temperature fluid and while providing desired lubrication.

During the pressure or extention stroke of the piston 16, fluid is forced out of the mixing column 24 through an outlet valve 56 in the valve chamber 22 and into the fluid system 18 thus pumping high temperature fluid mixed with some cool fluid to the fluid utilization device.

To control fluid temperatures adjacent the piston 16 and packing 52, the cooling jacket 26 is mounted and surrounds the fluid column 24 adjacent to the piston 16. The cooling jacket 26 also serves to dissipate frictional heat generated between the piston liner 44 and the piston 16, thereby reducing frictional wear.

The second cooling jacket 34 is located a distance from the first cooling jacket 26 and upward of the fluid column 24, thus defining a warm area of mixed cool and high temperature fluid between the cooling jacket 34 and the valve chamber 22. A lower temperature fluid area exists between the cooling jackets 34 and 26, thus, two different warm zones of fluid within the cooling chamber 24 are defined.

In operation, the present invention pumps a measured amount of high temperature fluid during each stroke of the piston 16. During the suction stroke, high temperature fluid is drawn from the fluid system 18 into the fluid or mixing column 24. The amount of fluid drawn into the mixing column 24 is determined by the area, the length of the stroke, the strokes per minute and number of pistons 16 employed in the pump 12. By controlling these parameters, the amount of fluid introduced into each column 24 can be controlled and thus the temperature within the column 24 is also controlled thereby insuring that the temperature of the fluid in the fluid system 18 is reduced minimally during the pumping cycle. The fluid portion of column 24 that is in direct fluid communication with the piston 16 and its packing 52, provides lubrication and cooling, resulting in lower packing and liner temperatures for a given pumped fluid temperature.

The present invention thus increases the life of the packing 52 while also allowing the use of a wider variety of packing materials.

While only a single embodiment of the present invention has been shown, it will be understood that various changes and modifications may occur to those skilled in the art and it is contemplated by the appended claims to cover all such changes and modifications as fall within the true spirit and scope of the present invention.

What is claimed as new and desired to be secured by Letters Patent is:

1. A pump drive system for pumping fluid comprising a fluid pump including a housing, a fluid plunger in said housing and means for reciprocating said plunger, a fluid column including a first inlet in fluid communication with said plunger and a second inlet in fluid communication with said fluid to be pumped and first means for cooling said fluid mounted on said column near said first inlet.

2. The system set forth in claim 1 further comprising fluid valve means on said second fluid inlet for controlling the introduction of said fluid into said column and the exhaust of said fluid from said column.

3. The system set forth in claim 1 wherein said fluid column is L shaped and includes a first portion axially extending from said plunger and a second portion substantially perpendicular to said first portion extending to said second inlet.

4. The system set forth in claim 1 further comprising second means for cooling said fluid mounted on said column near said fluid pump.

5. A device for a fluid pump employed to pump high temperature fluid comprising a fluid column in fluid communication with said pump and said high temperature fluid, said fluid column including a first fluid port in fluid communication with a fluid plunger of said pump and a second port in fluid communication with said high temperature fluid, said second port spaced from said first port and defining a mixing chamber therebetween wherein said high temperature fluid is mixed with fluid in said column during pumping by said pump.

6. The device claimed in claim 5 wherein said fluid column is L shaped including first and second leg portions.

7. The device claimed in claim 5 further comprising means for cooling said fluid in said fluid column.

8. In a fluid pump of the type for pumping high temperature fluid in a fluid system including a fluid piston or the like and means for actuating said piston to pump said fluid, the improvement comprising:

a fluid column containing fluid and in fluid communication with said piston and in fluid communication with said system, said column further comprising a body defined between said system and said piston and defining a mixing chamber for mixing said high temperature fluid and said fluid in said column.

9. The improvement set forth in claim 8 further comprising valve means at said second inlet for controlling the flow of high temperature fluid from said system into said column.

10. The improvement set forth in claim 8 further comprising means for cooling said fluid in said column.

11. The improvement set forth in claim 8 wherein said fluid column is L shaped.

* * * * *